US011600220B2

(12) United States Patent
Xiu et al.

(10) Patent No.: US 11,600,220 B2
(45) Date of Patent: Mar. 7, 2023

(54) TIMING CONTROLLER BOARD, MAIN CONTROL BOARD, DISPLAY DEVICE, AND DETECTION METHOD THEREOF

(71) Applicants: Hefei BOE Display Technology Co., Ltd., Anhui (CN); BOE Technology Group Co., Ltd., Beijing (CN)

(72) Inventors: Tianxun Xiu, Beijing (CN); Changcheng Liu, Beijing (CN); Yanping Liao, Beijing (CN); Yinlong Zhang, Beijing (CN); Ming Deng, Beijing (CN); Guohuo Su, Beijing (CN); Jiantao Liu, Beijing (CN)

(73) Assignees: Hefei BOE Display Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/498,411

(22) Filed: Oct. 11, 2021

(65) Prior Publication Data

US 2022/0301491 A1 Sep. 22, 2022

(30) Foreign Application Priority Data

Mar. 18, 2021 (CN) ..... 202110291523.6

(51) Int. Cl.
*G09G 3/32* (2016.01)

(52) U.S. Cl.
CPC ..... *G09G 3/32* (2013.01); *G09G 2310/08* (2013.01); *G09G 2330/12* (2013.01)

(58) Field of Classification Search
CPC ... G09G 3/32; G09G 2310/08; G09G 2330/12
See application file for complete search history.

(56) References Cited

U.S. PATENT DOCUMENTS

2021/0020136 A1* 1/2021 Zhao ..... G09G 3/36

* cited by examiner

*Primary Examiner* — Kenneth B Lee, Jr.
(74) *Attorney, Agent, or Firm* — Ipro, PLLC

(57) ABSTRACT

The disclosure discloses a timing controller board, a main control board, a display device and a detection method thereof. The timing controller board outputs a second level signal transmitted by a first fixed potential signal pin to the main control board through a detection circuit when a first data signal pin outputs a first level signal; the main control board loads a second potential signal transmitted by a second fixed potential signal pin to a second data signal pin and a clock signal pin through a switching circuit upon receiving the second level signal, to cause the main control board to stop sending a data signal to the timing controller board through the second data signal pin and stop sending a clock signal to the timing controller board through the clock signal pin.

13 Claims, 3 Drawing Sheets

TIMING CONTROLLER BOARD, MAIN CONTROL BOARD, DISPLAY DEVICE, AND DETECTION METHOD THEREOF

CROSS-REFERENCE TO RELATED APPLICATIONS

The present disclosure claims priority to Chinese Patent Application No. 202110291523.6, filed with the China National Intellectual Property Administration on Mar. 18, 2021, the content of which is incorporated herein by reference in its entirety.

FIELD

The present disclosure relates to the field of the display technology, and particularly to a timing controller board, a main control board, a display device, and a detection method thereof.

BACKGROUND

Current display devices generally employ a System on Chip (SoC) as a main control board for controlling a display panel in which a Timing Controller (Tcon) board is arranged at the same time, and the main control board and the Tcon board are connected using a bidirectional Inter-Integrated Circuit (IIC). The SoC end outputs data or a clock signal through the IIC to the Tcon end, while the Tcon end may likewise send data through the IIC to the Soc end in some cases.

With continuous development of the display technology, high-resolution high-refresh-rate display products attract more and more attention, more functions of a display device may require a larger number of chips of the Tcon board, thereby resulting in a larger number of IIC paths connected to the SoC. If the Tcon end transmits data to the IIC at the same time when the SoC end transmits data to the IIC, a mutual collision may occur. Such data collision would overwrite data on the original IIC paths to produce random data, resulting in a failure of the function of the SoC end, and in severe cases, if the random data is for address bits of the chips, there may be a risk of overwriting the chips, resulting in adverse effects.

SUMMARY

Embodiments of the present disclosure provide a timing controller board, a main control board, a display device, and a detection method thereof.

In a first aspect, an embodiment of the present disclosure provides a timing controller board, including a plurality of first connection pins connected correspondingly to second connection pins of a main control board through a flexible flat cable. The timing controller board further includes: a detection circuit, where the plurality of first connection pins include a first data signal pin and a first fixed potential signal pin, and the detection circuit is electrically connected to the first data signal pin and the first fixed potential signal pin respectively; the detection circuit includes an output end connected to an input end of a switching circuit in the main control board through the flexible flat cable; the detection circuit is configured to, when the first data signal pin outputs a first level signal, output a second level signal transmitted by the first fixed potential signal pin to cause the main control board to stop outputting a signal to the timing controller board.

In a second aspect, an embodiment of the present disclosure provides a main control board, including a plurality of second connection pins correspondingly connected to first connection pins of a timing controller board through a flexible flat cable. The main control board further includes a switching circuit, where the plurality of second connection pins include a second data signal pin, a clock signal pin, and a second fixed potential signal pin, and the switching circuit is electrically connected to the second data signal pin, the clock signal pin and the second fixed potential signal pin respectively; the switching circuit includes an input end connected to the output end of the detection circuit in the timing controller board through the flexible flat cable; the switching circuit is configured to, when the input end receives a second level signal output by the timing controller board, load a second level signal transmitted by the second fixed potential signal pin to the second data signal pin and the clock signal pin to cause the main control board to stop outputting a signal to the timing controller board.

In a third aspect, an embodiment of the present disclosure provides a display device including the above timing controller board and the above main control board, the first connection pins of the timing controller board are correspondingly connected to the second connection pins of the main control board through the flexible flat cable.

In a fourth aspect, an embodiment of the present disclosure provides a detection method of the above display device, including: the timing controller board outputting the second level signal transmitted by the first fixed potential signal pin to the main control board through the detection circuit when the first data signal pin outputs the first level signal; and the main control board loading the second potential signal transmitted by the second fixed potential signal pin to the second data signal pin and the clock signal pin through the switching circuit upon receiving the second level signal, to cause the main control board to stop sending a data signal to the timing controller board through the second data signal pin and stop sending a clock signal to the timing controller board through the clock signal pin.

BRIEF DESCRIPTION OF THE DRAWINGS

In order to more clearly explain the technical solutions of embodiments of the present disclosure, the accompanying drawings required to be used in embodiments of the present disclosure will be briefly described below, and it may be apparent that the accompanying drawings described below are merely some embodiments of the present disclosure, and those of ordinary skilled in the art can obtain other accompanying drawings based on these accompanying drawings without creative work.

DETAILED DESCRIPTION

Figure 1:
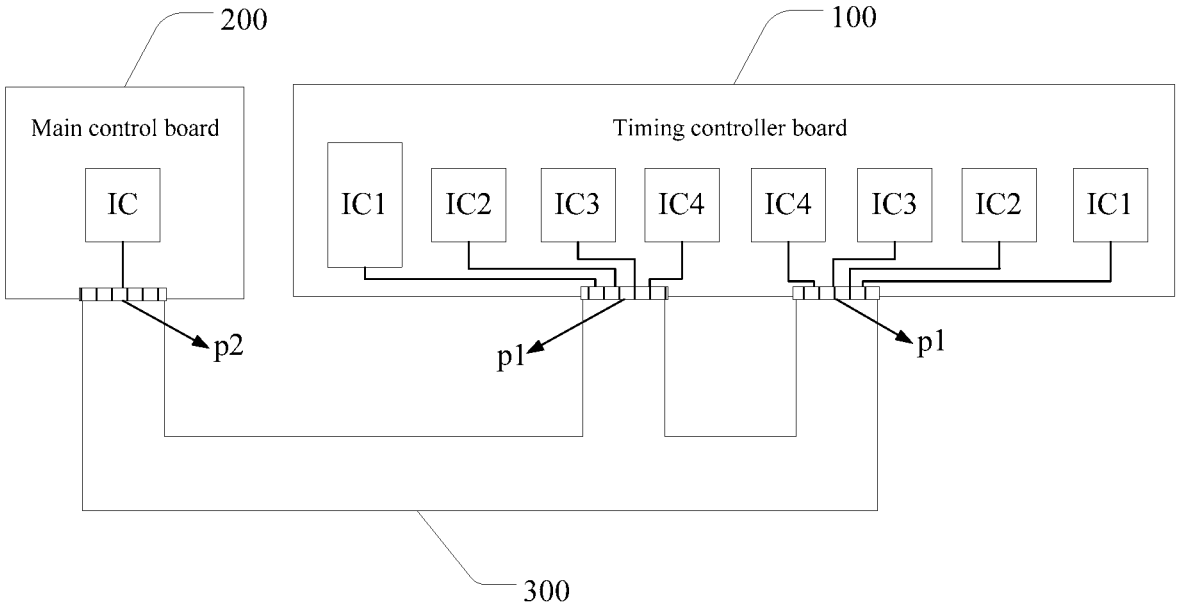
FIG. 1 is a structural schematic diagram of a display device provided by an embodiment of the present disclosure.

In order to make the above objectives, features and advantages of the present disclosure more evident and easier to understood, the present disclosure will now be further described with reference to the accompanying drawings and embodiments. Embodiments may, however, be implemented in many forms and should not be construed as limitation to embodiments set forth herein; and on the contrary, these embodiments provided make the present disclosure thorough and complete, and the concept of embodiments will be fully conveyed to those skilled in the art. The same reference numerals denote the same or similar structures in the accompanying drawings, and thus repeated description thereof will be omitted. Words expressing positions and directions described in the present disclosure are illustrated by way of example in the accompanying drawings, but may be subjected to changes as required, and these changes are within the scope of the present disclosure. The accompanying drawings of the present disclosure are only used to illustrate the relative positional relationships and do not represent true scale.

FIG. 1 is a structural schematic diagram of a display device provided by an embodiment of the present disclosure.

As shown in FIG. 1, the display device provided by an embodiment of the present disclosure includes a timing controller board 100 and a main control board 200, where the timing controller board 100 and the main control board 200 are connected through a Flexible Flat Cable (FFC). The timing controller board 100 is arranged on a display panel, and a plurality of chips for controlling the display panel are arranged on the timing controller board 100; the main control board 200 is a system end of the display device, and a System on Chip (SoC) is arranged on the main control board 200. The SoC communicates with the timing controller board 100 using an Inter-Integrated Circuit (IIC) protocol, the IIC can enable bidirectional data transmission, that is, the main control board 200 may send a data signal or a clock signal to the timing controller board 100 through the IIC, and the timing controller board 100 may also send a data signal to the main control board 200 through the IIC.

However, if the timing controller board 100 sends data to the main control board 200 at the same time when the main control board 200 sends data to the timing controller board 100, data collision occurs at the moment, and such data collision may overwrite data on an original IIC to produce random data, resulting in a failure of the function of the main control board 200; and in severe cases, there will be a risk of overwriting the chips if the random data is for address bits of the chips, resulting in adverse effects.

As shown in FIG. 1, with the continuous development of the display technology, in a high-resolution and high-refresh-rate display device, more chips, such as IC1-IC4 in FIG. 1, are arranged on the timing controller board 100. For example, these chips may be a Timing Controller Integrated Circuit (Tcon IC), a Power Management Integrated Circuit (PMIC), a Power Conversion Integrated Circuit (L/S IC), a Programmable Gamma Voltage Control Integrated Circuit (PGAMMA ICs), or the like. The Tcon IC is configured to output a timing controller signal required for display to the display panel; the PMIC may provide various voltage signals required for the display panel; the L/S IC may convert a power supply signal into a voltage signal usable by the display panel; and the PGAMMA IC is configured to adjust a gamma voltage of the display panel. The chips arranged on the above timing controller board 100 are each controlled by the SoC on the main control board 200. If data collision occurs on the IIC, the failure of the function of the SoC is produced. As the function of the display device is improved constantly, more chips may be arranged in the display device to subsequently produce a greater probability of data collision on the IIC.

In order to solve the above technical problems, in embodiments of the present disclosure, improvements are made to circuits of the timing controller board 100 and the main control board 200 respectively, Thus, when the timing controller board 100 outputs a data signal, the IIC of the main control board 200 is set to be at a high level, so that the main control board 200 stops sending data through the IIC; and after a program is adjusted, the main control board 200 is reset to resume communication with the timing controller board 100.

First, it should be noted that the timing controller board 100 and the master control board 200 are in a mater-slave relationship, where the main control board 200 is a master device end, and plays the role of control; and the timing controller board 100 is a slave device end and is controlled by the main control board 200. Generally, the timing controller board 100 may send data to the main control board 100 in response to instructions from the main control board 200 and may not actively send data to the main control board 200. When the timing controller board 100 sends data through the IIC, it is a point of time when data collision is likely to occur. In an embodiment of the present disclosure, in order to avoid data collision, the point of time when the timing controller board 100 sends data needs to be detected, and the main control board 200 and the timing controller board 100 are prevented from sending data simultaneously at the above point of time by adjusting the program. The IIC transmits data only at a low level, the main control board 200 can stop sending data through the IIC by setting the IIC of the main control board 200 to be at a high level after it is detected that the timing controller board 100 sends data through the IIC.

Figure 2:
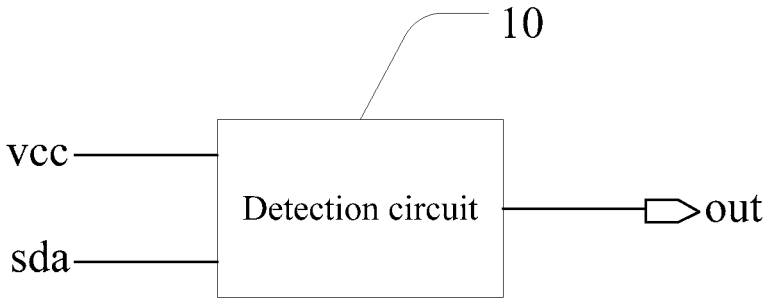
FIG. 2 is a first structural schematic diagram of a timing controller board provided by an embodiment of the present disclosure.

FIG. 2 is a first structural schematic diagram of a timing controller board provided by an embodiment of the present disclosure.

As shown in FIGS. 1 and 2, the timing controller board 100 provided by an embodiment of the present disclosure includes a plurality of first connection pins p1 that are correspondingly connected to second connection pins p2 of a main control board 200 through a flexible flat cable 300.

As shown in FIG. 2, in order to realize a detection function, in an embodiment of the present disclosure, a detection circuit 10 is arranged in the timing controller board; where the plurality of first connection pins p1 include a first data signal pin sda and a first fixed potential signal pin vcc, and the detection circuit 10 is electrically connected to the first data signal pin sda and the first fixed potential signal pin vcc respectively; and the detection circuit 10 includes an output end out connected to an input end (not shown in FIG. 2) of a switching circuit in the main control board 200 through the flexible flat cable 300.

The detection circuit 10 is configured to, when the first data signal pin sda outputs a first level signal, output a second level signal transmitted by the first fixed potential signal pin vcc, to cause the main control board 200 to stop outputting a signal to the timing controller board 100.

The first level signal may be a low level signal and the second level signal may be a high level signal. The first fixed potential signal pin vcc is configured to transmit a fixed potential signal which is generally a high level signal, i.e., the above second level signal.

When the first data signal pin sda transmits the first level signal, i.e., the low level signal, it shows that an IIC on one side of the timing controller board 100 is transmitting data, and then a data collision occurs if the main control board 200 is also transmitting data through the IIC. To avoid data collision on the IIC, in an embodiment of the present disclosure, the detection circuit 10 as shown in FIG. 2 is added to the timing controller board 100, the detection circuit 10 outputs a second level signal transmitted by the first fixed potential signal pin vcc to the main control board 200 when the first data signal pin sda outputs the first level signal, and when the main control board 200 receives the second level signal, the IIC of the main control board 200 is set to be in at a high level to stop outputting a signal to the timing controller board 100, thereby avoiding a problem of data collision.

Figure 3:
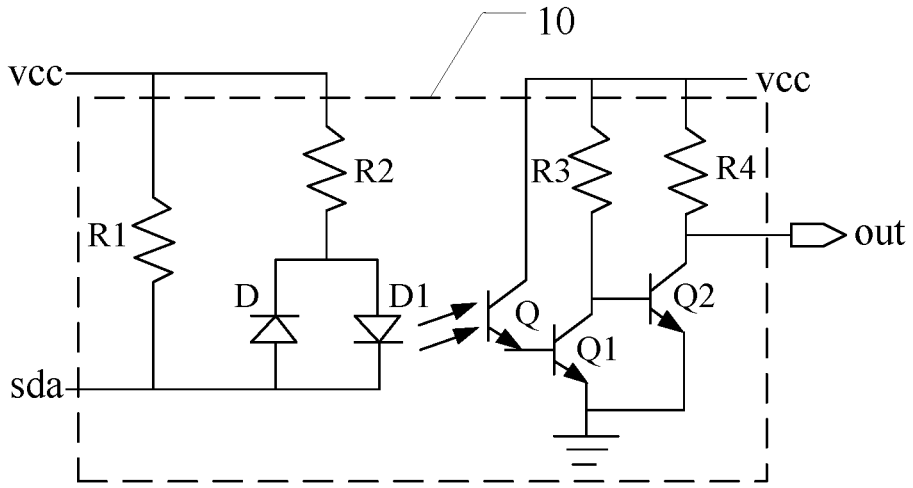
FIG. 3 is a second structural schematic diagram of a timing controller board provided by an embodiment of the present disclosure.

FIG. 3 is a second structural schematic diagram of a timing controller board provided by an embodiment of the present disclosure.

As shown in FIG. 3, the detection circuit 10 may include a first light emitting diode D1, a photoelectric triode Q, a first triode Q1, and a second triode Q2.

A positive electrode of the first light emitting diode D1 is electrically connected to the first fixed potential signal pin vcc, and a negative electrode of the first light emitting diode D1 is electrically connected to the first data signal pin sda; and the first light emitting diode D1 is turned on to emit light when the first data signal pin sda outputs the first level signal.

A first electrode of the photoelectric triode Q is electrically connected to the first fixed potential signal pin vcc, and a second electrode of the photoelectric triode Q is electrically connected to a base of the first triode Q1; the photoelectric triode Q transmits a signal from the first electrode to the second electrode under illumination by the light emitted from the first light emitting diode D1.

A first electrode of the first triode Q1 is electrically connected to the first fixed potential signal pin vcc, and a second electrode of the first triode Q1 is grounded.

A base of the second triode Q2 is electrically connected to the first electrode of the first triode Q1, a first electrode of the second triode Q2 is electrically connected to the first fixed potential signal pin vcc, and a second electrode of the second triode Q2 is grounded.

The output end out of the detection circuit 10 is connected to the first electrode of the second triode Q2.

The detection circuit 10 in an embodiment of the present disclosure can be designed as an optical-coupling cascade amplification circuit. When the first data signal pin sda outputs the first level signal, i.e., the low level signal, the first light emitting diode D1 between the first fixed potential signal pin vcc and the first data signal pin sda is turned on to emit light, the first light emitting diode D1 emits light to drive the photoelectric triode Q to further load the second level signal of the first fixed potential signal pin vcc, i.e., the high level signal, to the base of the first triode Q1 to turn on the first triode Q1, at this moment, a ground signal is loaded to the base of the second triode Q2 by the first triode Q1 to turn off the second triode Q2, and a signal output by the output end out of the detection circuit 10 is the second level signal, i.e., the high level signal, of the first fixed potential signal pin vcc. Therefore, when the main control board 200 receives the above second level signal, the IIC of the main control board is set to be at the high level to stop outputting a signal to the timing controller board 100, thereby avoiding a problem of data collision.

Further, as shown in FIG. 3, the detection circuit 10 further includes a diode D, a positive electrode of the diode D is electrically connected to the first data signal pin sda, and a negative electrode of the diode D is electrically connected to the first fixed potential signal pin vcc. The diode D and the first light emitting diode D1 are connected in parallel, and are in a reverse connection, which may improve the safety of a circuit.

As shown in FIG. 3, the detection circuit 10 further includes: a first resistor R1 connected between the first fixed potential signal pin vcc and the first data signal pin sda, a second resistor R2 connected between the first fixed potential signal pin vcc and the positive electrode of the first light emitting diode D1, a third resistor R3 connected between the first fixed potential signal pin vcc and the first electrode of the first triode Q1, and a fourth resistor R4 connected between the first fixed potential signal pin vcc and the first electrode of the second triode Q2. The above resistors arranged in the detection circuit 10 play the roles of voltage division and circuit protection.

Figure 4:
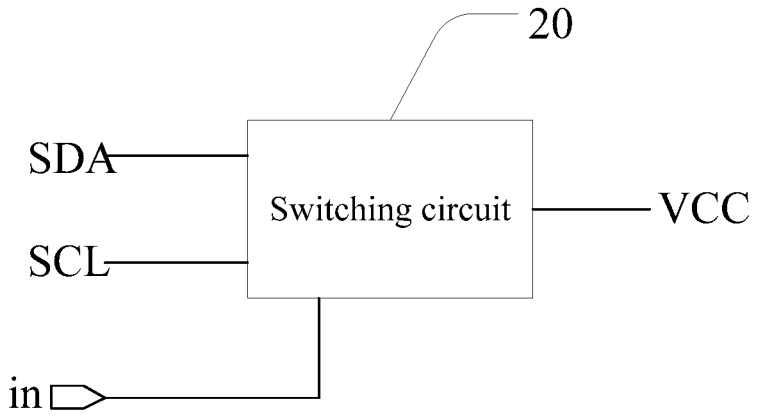
FIG. 4 is a first structural schematic diagram of a main control board provided by an embodiment of the present disclosure.

FIG. 4 is a first structural schematic diagram of a main control board provided by an embodiment of the present disclosure.

As shown in FIGS. 1 and 4, the main control board 200 provided by an embodiment of the present disclosure includes a plurality of second connection pins p2 which are correspondingly connected to the first connection pins p1 of the timing controller board 100 through the flexible flat cable 300.

As shown in FIG. 4, to implement a switching function, in an embodiment of the present disclosure, a switching circuit 20 is arranged in the main control board; where the plurality of second connection pins p2 include a second data signal pin SDA, a clock signal pin SCL, and a second fixed potential signal pin VCC, and the switching circuit 20 is electrically connected to the second data signal pin SDA, the clock signal pin SCL, and the second fixed potential signal pin VCC respectively; and the switching circuit 20 includes an input end in connected to the output end (not shown in the figure) of the detection circuit in the timing controller board 100 through the flexible flat cable 300.

The switching circuit 20 is configured to, when the input end in receives a second level signal output by the timing controller board 100, load a second level signal transmitted by the second fixed potential signal pin VCC to the second data signal pin SDA and the clock signal pin SCL, to cause the main control board 200 to stop outputting a signal to the timing controller board 100.

The second level signal is a high level signal. The second fixed potential pin VCC is configured to transmit a fixed potential signal which is generally a high level signal, i.e., the above second level signal.

When the switching circuit 20 receives the second level signal output by the timing controller board 100, it shows that data is transmitted on the IIC of the timing controller board 100 at the moment, and then data collision occurs if the main control board 200 also sends data through the IIC at the moment. To avoid data collision on the IIC, in an embodiment of the present disclosure, the switching circuit 20 as shown in FIG. 4 is added to the main control board 200. The switching circuit 20 loads, under control of the second level signal, the second level signal of the second fixed potential signal pin VCC to the second data signal pin SDA and the clock signal pin SCL, so that the second data signal pin SDA and the clock signal pin SCL are set to be at a high level, and the main control board 200 and the IIC are disconnected to stop outputting a signal to the timing controller board 100, thereby avoiding a problem of data collision.

Figure 5:
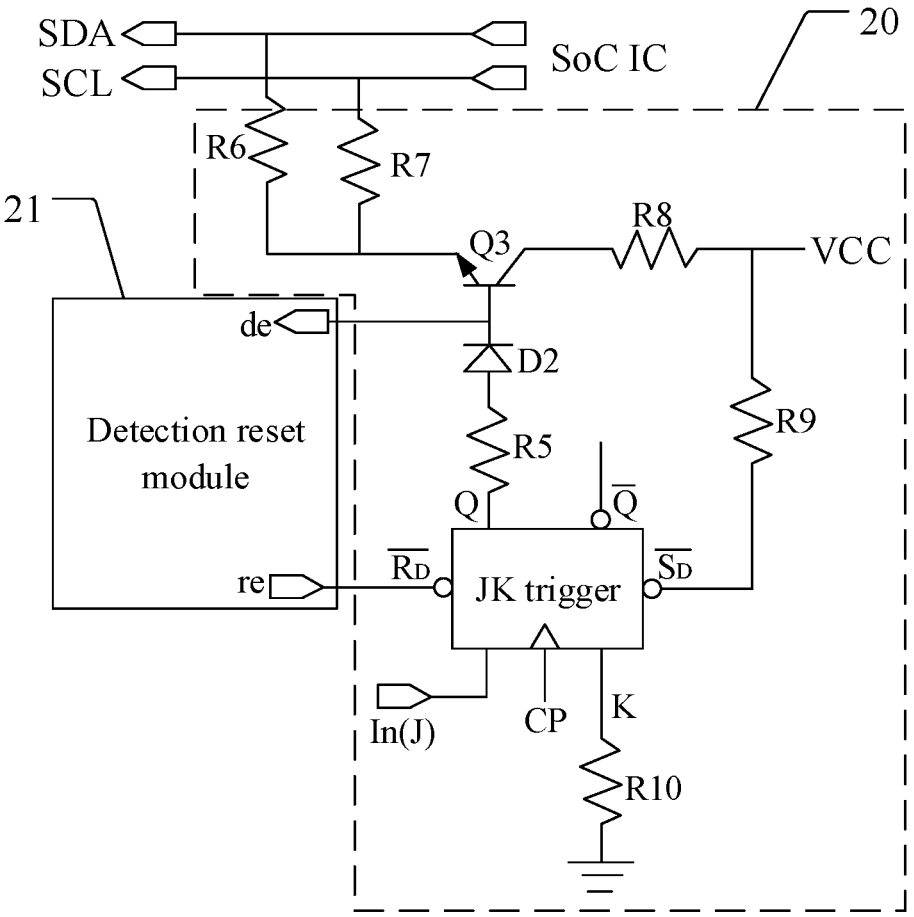
FIG. 5 is a second structural schematic diagram of a main control board provided by an embodiment of the present disclosure.

FIG. 5 is a second structural schematic diagram of a main control board provided by an embodiment of the present disclosure.

As shown in FIG. 5, the switching circuit 20 may include a JK trigger and a third triode Q3.

An end J of the JK trigger serves as the input end in of the switching circuit 20, an end K of the JK trigger is grounded, an end Q of the JK trigger is electrically connected to a base of the third triode Q3, and an end $\overline{S}_D$ of the JK trigger is electrically connected to the second fixed potential signal pin.

A first electrode of the third triode Q3 is electrically connected to the second fixed potential signal pin VCC, and a second electrode of the third triode Q3 is electrically connected to the second data signal pin SDA and the clock signal pin SCL respectively.

In an embodiment of the present disclosure, the JK trigger is arranged in the switching circuit 20, by the utilization of the inherent nature of the JK trigger, when the input end in of the switching circuit 20, i.e., the end J of the JK trigger, is in the second level signal (i.e., the high level signal), and the end K of the JK trigger is grounded, i.e., the end K is in a low level signal, the end Q of the JK trigger is set to be in a high level signal, and the JK trigger may maintain the state all the time. The end Q of the JK trigger is connected to the third triode Q3, a high level signal is loaded to the base of the third triode Q3, the third triode Q3 is turned on, and at this moment, the second level signal of the second fixed potential signal pin VCC is loaded to the second data signal pin SDA and the clock signal pin SCL by the third triode, so that the second data signal pin SDA and the clock signal pin SCL are set to be at a high level, and the main control board 200 and the IIC are disconnected to stop outputting a signal to the timing controller board 100, thereby avoiding a problem of data collision.

Further, as shown in FIG. 5, the switching circuit 20 further includes a second light emitting diode D2, a positive electrode of the second light emitting diode D2 is electrically connected to the end Q of the JK trigger, and a negative electrode of the second light emitting diode D2 is electrically connected to the base of the third triode Q3. The second light emitting diode D2 is arranged between the JK trigger and the third triode Q3 and can automatically emit light when data is output by the timing controller board 100, thereby reminding staff of a problem that data collision may occur at the moment.

As shown in FIG. 5, the switching circuit 20 further includes: a fifth resistor R5 connected between the end Q of the JK trigger and the base of the third triode Q3, a sixth resistor R6 connected between the second electrode of the third triode Q3 and the second data signal pin SDA, a seventh resistor R7 connected between the second electrode of the third triode Q3 and the clock signal pin SCL, an eighth resistor R8 connected between the second fixed potential signal pin VCC and the first electrode of the third triode Q3, a ninth resistor R9 connected between the second fixed potential signal pin VCC and the end $\overline{S}_D$ of the JK trigger, and a tenth resistor R10 connected to the end K of the JK trigger. The above resistors arranged in the switching circuit 20 play the roles of voltage division and circuit protection.

As shown in FIG. 5, the main control board provided by an embodiment of the present disclosure further includes a detection reset module 21; the detection reset module 21 includes a detection end de and a reset end re; and the detection end de is electrically connected to the base of the third triode Q3, and the reset end re is electrically connected to an end $\overline{R}_D$ of the JK trigger.

The detection reset module 21 is configured to detect a potential at the detection end de when a second level signal is input to the input end in of the switching circuit 20, and to output a first level signal to the reset end re when the JK trigger is reset.

The first level signal is a low level signal and the second level signal is a high level signal.

When the detection end de derives between the second light emitting diode D2 and the third triode Q3, and can detect that a level signal is changed from a low level signal to a high potential signal, it shows that the timing controller board 100 sends data through the IIC at the moment, and a problem of data collision is likely to occur at the moment, and by a level detection through the detection end de, the above problem can be detected.

After the above problems are discovered, programs of the timing controller board 100 and the main control board 200 are adjusted, the problem that data collision may occur is detected, and then the JK trigger can be reset. Before that, since the end J of the JK trigger is in a high level signal and the end K is grounded to be in a low level signal, the JK trigger is in a holding state, and the JK trigger can be reset by sending a low level signal to the reset end re, i.e., the end $\overline{R}_D$ of the JK trigger, and the third triode Q3 is turned off, thereby resuming that the main control board sends a signal through the second data signal pin SDA and the clock signal pin SCL.

Based on the same concept disclosed, an embodiment of the present disclosure also provides a display device provided with any one of the above timing controller boards 100 and any one of the above main control boards 200. The first connection pins p1 of the timing controller board 100 are correspondingly connected to the second connection pins p2 of the main control board 200 through the flexible flat cable 300. Since the principle of solving the problems of the display device is similar to that of the above timing controller board 100 and main control board 200, the implementation of the display device can refer to the implementation of the above timing controller board 100 and main control board 20, and the repeated parts will not be described.

In another aspect, an embodiment of the present disclosure also provides a detection method of a display device. The detection method is applied to a detection phase after assembly of a timing controller board and a main control board, and a point in time when data collision may occur to the main control board and the timing controller board can be detected, thereby making adjustments to the programs of the main control board and the timing controller board to avoid a problem of data collision.

Figure 6:
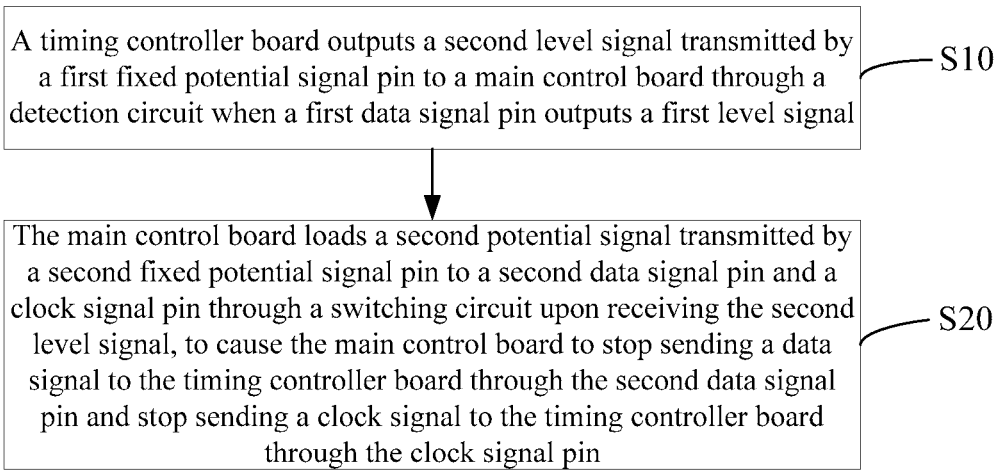
FIG. 6 is a flowchart of a detection method of a display device provided by an embodiment of the present disclosure.

FIG. 6 is a flowchart of a detection method of a display device provided by an embodiment of the present disclosure.

As shown in FIG. 6, a detection method of a display device includes following steps.

S10, a timing controller board outputs a second level signal transmitted by a first fixed potential signal pin to a main control board through a detection circuit when a first data signal pin outputs a first level signal.

S20, the main control board loads a second potential signal transmitted by a second fixed potential signal pin to a second data signal pin and a clock signal pin through a switching circuit upon receiving the second level signal, to cause the main control board to stop sending a data signal to the timing controller board through the second data signal pin and stop sending a clock signal to the timing controller board through the clock signal pin.

When the first data signal pin in the timing controller board transmits the first level signal, i.e., a low level signal, it shows that an IIC on one side of the timing controller board is transmitting data, and then data collision may occur if the main control board is also transmitting data through the IIC. To avoid data collision on the IIC, in an embodiment of the present disclosure, when it is detected that the first data signal pin of the timing controller board outputs a first level signal, a second level signal, i.e., a high level signal, transmitted by the first fixed potential signal pin is output to the main control board, when the main control board receives the above second level signal, a second level signal, i.e., a high level signal, transmitted by the second fixed potential signal pin of the main control board is loaded to the second data signal pin and the clock signal pin, so that the second data signal pin and the clock signal pin are set to be at a high level, and the main control board and the IIC are disconnected to stop the main control board from outputting a signal to the timing controller board, thereby avoiding a problem of data collision.

In the display device provided by an embodiment of the present disclosure, a detection reset module is further arranged in the main control board, the reset module is provided with a detection end that can detect a change in a potential signal, and thus when the timing controller board outputs a second level signal to the main control board, the detection end can detect the second level signal, i.e., a high level signal, thereby recording the point in time when data collision may occur.

The problem of data collision can be avoided after program adjustment is made to the main control board and the timing controller board according to data at the above point in time, and at this moment, the main control board can be reset to resume that the main control board sends a data signal and a clock signal to the timing controller board.

When the main control board is reset, a first level signal, i.e., a low level signal, may be output to a reset end of the detection reset module to control the switching circuit of the main control board to reset to cause the main control board to resume sending a data signal to the timing controller board through the second data signal pin and sending a clock signal to the timing controller board through the clock signal pin.

According to the timing controller board, the main control board, the display device, and the detection method thereof provided by embodiments of the present disclosure, the detection circuit is added to the timing controller board and the switching circuit is added to the main control board. When the first data signal pin in the timing controller board transmits a first level signal, a second level signal transmitted by the first fixed potential signal pin is output to the main control board. When the main control board receives the above second level signal, and a second level signal transmitted by the second fixed potential signal pin of the main control board is loaded to the second data signal pin and the clock signal pin, so that the second data signal pin and the clock signal pin are set to be at a high level, the main control board and the IIC are disconnected to stop the main control board from outputting a signal to the timing controller board, thereby avoiding a problem of data collision.

Although embodiments of the present disclosure have been described, those skilled in the art can make other changes and modifications to these embodiments once learning the basic creative concept. Therefore, the appended claims intend to be construed to include embodiments and all changes and modifications that fall within the scope of the present disclosure.

Obviously, those skilled in the art can make various alternations and variations to the present disclosure without departing from the spirit and scope of the present disclosure. Thus, the present disclosure intends to include these alternations and variations if they come within the scope of the claims and their equivalents of the present disclosure.

What is claimed is:

1. A timing controller board, comprising a plurality of first connection pins which are correspondingly connected to second connection pins of a main control board through a flexible flat cable, and further comprising a detection circuit; wherein the plurality of first connection pins comprise a first data signal pin and a first fixed potential signal pin, and the detection circuit is electrically connected to the first data signal pin and the first fixed potential signal pin respectively; the detection circuit comprises an output end connected to an input end of a switching circuit in the main control board through the flexible flat cable; and the detection circuit is configured to, when the first data signal pin outputs a first level signal, output a second level signal transmitted by the first fixed potential signal pin to cause the main control board to stop outputting a signal to the timing controller board;

wherein the detection circuit comprises: a first light emitting diode, a photoelectric triode, a first triode, and a second triode;

a positive electrode of the first light emitting diode is electrically connected to the first fixed potential signal pin, and a negative electrode of the first light emitting diode is electrically connected to the first data signal pin; the first light emitting diode is turned on to emit light when the first data signal pin outputs the first level signal;

a first electrode of the photoelectric triode is electrically connected to the first fixed potential signal pin, and a second electrode of the photoelectric triode is electrically connected to a base of the first triode; the photoelectric triode transmits a signal from the first electrode to the second electrode under illumination by the light emitted from the first light emitting diode;

a first electrode of the first triode is electrically connected to the first fixed potential signal pin, and a second electrode of the first triode is grounded;

a base of the second triode is electrically connected to the first electrode of the first triode, a first electrode of the second triode is electrically connected to the first fixed potential signal pin, and a second electrode of the second triode is grounded; and the output end of the detection circuit is connected to the first electrode of the second triode.

2. The timing controller board of claim 1, wherein the detection circuit further comprises: a diode, a positive electrode of the diode being electrically connected to the first data signal pin, and a negative electrode of the diode being electrically connected to the first fixed potential signal pin.

3. The timing controller board of claim 2, wherein the detection circuit further comprises: a first resistor connected between the first fixed potential signal pin and the first data signal pin, a second resistor connected between the first fixed potential signal pin and the positive electrode of the first light emitting diode, a third resistor connected between the first fixed potential signal pin and the first electrode of the first triode, and a fourth resistor connected between the first fixed potential signal pin and the first electrode of the second triode.

4. The timing controller board of claim 1, wherein the first level signal is a low level signal and the second level signal is a high level signal.

5. A main control board, comprising a plurality of second connection pins which are correspondingly connected to first connection pins of a timing controller board through a flexible flat cable, and further comprising: a switching circuit; wherein the plurality of second connection pins comprise a second data signal pin, a clock signal pin, and a second fixed potential signal pin, and the switching circuit is electrically connected to the second data signal pin, the clock signal pin, and the second fixed potential signal pin respectively; the switching circuit comprises an input end connected to an output end of a detection circuit in the timing controller board through the flexible flat cable; and the switching circuit is configured to, when the input end receives a second level signal output by the timing controller board, load a second level signal transmitted by the second fixed potential signal pin to the second data signal pin and the clock signal pin to cause the main control board to stop outputting a signal to the timing controller board;

wherein the switching circuit comprises: a JK trigger and a third triode;

an end J of the JK trigger serves as the input end of the switching circuit, an end K of the JK trigger is grounded, an end Q of the JK trigger is electrically connected to a base of the third triode, and an end $\overline{S}_D$ of the JK trigger is electrically connected to the second fixed potential signal pin; and a first electrode of the third triode is electrically connected to the second fixed potential signal pin, and a second electrode of the third triode is electrically connected to the second data signal pin and the clock signal pin respectively.

6. The main control board of claim 5, wherein the switching circuit further comprises a second light emitting diode, a positive electrode of the second light emitting diode is electrically connected to the end Q of the JK trigger, and a negative electrode of the second light emitting diode is electrically connected to the base of the third triode.

7. The main control board of claim 6, wherein the switching circuit further comprises: a fifth resistor connected between the end Q of the JK trigger and the base of the third triode, a sixth resistor connected between the second electrode of the third triode and the second data signal pin, a seventh resistor connected between the second electrode of the third triode and the clock signal pin, an eighth resistor connected between the second fixed potential signal pin and the first electrode of the third triode, a ninth resistor connected between the second fixed potential signal pin and the end $\overline{S}_D$ of the JK trigger, and a tenth resistor connected to the end K of the JK trigger.

8. The main control board of claim 7, wherein the main control board further comprises a detection reset module;

the detection reset module comprises a detection end and a reset end; the detection end is electrically connected to the base of the third triode, and the reset end is electrically connected to an end $\overline{R}_D$ of the JK trigger; and the detection reset module is configured to detect a potential at the detection end when a second level signal is input to the input end of the switching circuit, and to output a first level signal to the reset end when the JK trigger is reset.

9. The main control board of claim 8, wherein the first level signal is a low level signal and the second level signal is a high level signal.

10. A display device, comprising a timing controller board and a main control board, first connection pins of the timing controller board being correspondingly connected to second connection pins of the main control board through a flexible flat cable; wherein the timing controller board comprises a detection circuit; the plurality of first connection pins comprise a first data signal pin and a first fixed potential signal pin, and the detection circuit is electrically connected to the first data signal pin and the first fixed potential signal pin respectively; the detection circuit comprises an output end connected to an input end of a switching circuit in the main control board through the flexible flat cable; the detection circuit is configured to, when the first data signal pin outputs a first level signal, output a second level signal transmitted by the first fixed potential signal pin to cause the main control board to stop outputting a signal to the timing controller board; and the main control board comprises a switching circuit; the plurality of second connection pins comprise a second data signal pin, a clock signal pin, and a second fixed potential signal pin, and the switching circuit is electrically connected to the second data signal pin, the clock signal pin, and the second fixed potential signal pin respectively; the switching circuit comprises an input end connected to the output end of the detection circuit in the timing controller board through the flexible flat cable; the switching circuit is configured to, when the input end receives a second level signal output by the timing controller board, load a second level signal transmitted by the second fixed potential signal pin to the second data signal pin and the clock signal pin to cause the main control board to stop outputting the signal to the timing controller board;

wherein the detection circuit comprises: a first light emitting diode, a photoelectric triode, a first triode, and a second triode;

a positive electrode of the first light emitting diode is electrically connected to the first fixed potential signal pin, and a negative electrode of the first light emitting diode is electrically connected to the first data signal pin; the first light emitting diode is turned on to emit light when the first data signal pin outputs the first level signal;

a first electrode of the photoelectric triode is electrically connected to the first fixed potential signal pin, and a second electrode of the photoelectric triode is electrically connected to a base of the first triode; the photoelectric triode transmits a signal from the first electrode to the second electrode under illumination by the light emitted from the first light emitting diode;

a first electrode of the first triode is electrically connected to the first fixed potential signal pin, and a second electrode of the first triode is grounded;

a base of the second triode is electrically connected to the first electrode of the first triode, a first electrode of the second triode is electrically connected to the first fixed potential signal pin, and a second electrode of the second triode is grounded; and the output end of the detection circuit is connected to the first electrode of the second triode.

11. A detecting method of the display device of claim 10, comprising:

outputting, by the timing controller board, the second level signal transmitted by the first fixed potential signal pin to the main control board through the detection circuit when the first data signal pin outputs the first level signal; and loading, by the main control board, the second potential signal transmitted by the second fixed potential signal pin to the second data signal pin and the clock signal pin through the switching circuit upon receiving the second level signal, to cause the main control board to stop sending a data signal to the timing controller board through the second data signal pin and stop sending a clock signal to the timing controller board through the clock signal pin.

12. The detection method of claim 11, further comprising:

outputting the first level signal to a reset end of a detection reset module of the main control board, and controlling the switching circuit of the main control board to reset, to cause the main control board to resume sending the data signal to the timing controller board through the second data signal pin and sending the clock signal to the timing controller board through the clock signal pin.

13. The detection method of claim 11, further comprising:

detecting, by the main control board, a potential of a detection end of the detection reset module upon receiving the second level signal, and recording detection time.

* * * * *